US008336125B2

(12) United States Patent
Elders et al.

(10) Patent No.: US 8,336,125 B2
(45) Date of Patent: Dec. 25, 2012

(54) SHOULDER PROTECTOR AND SAFETY HARNESS

(75) Inventors: Leonardus Antonius Maria Elders, Rotterdam (NL); Johannes Gerardus Steenkamer, Rotterdam (NL)

(73) Assignee: Consulo B.V. (NL)

( * ) Notice: Subject to any disclaimer, the term of this patent is extended or adjusted under 35 U.S.C. 154(b) by 534 days.

(21) Appl. No.: 12/525,497

(22) PCT Filed: Feb. 1, 2008

(86) PCT No.: PCT/NL2008/050057

§ 371 (c)(1),
(2), (4) Date: Jul. 31, 2009

(87) PCT Pub. No.: WO2008/094040

PCT Pub. Date: Aug. 7, 2008

(65) Prior Publication Data

US 2010/0101892 A1 Apr. 29, 2010

(30) Foreign Application Priority Data

Feb. 1, 2007 (NL) ..... 2000462

(51) Int. Cl.
*A41D 27/26* (2006.01)

(52) U.S. Cl. ..... 2/459; 224/264

(58) Field of Classification Search ..... 482/69; 182/3; 2/45, 94, 310, 311, 327, 328, 267, 2/464, 455, 102, 95, 97, 44, 459, 460, 461, 2/268, 336, 337, 338, 312; 224/264, 643
See application file for complete search history.

(56) References Cited

U.S. PATENT DOCUMENTS

| | | | | | |
|---|---|---|---|---|---|
| 3,444,957 | A | * | 5/1969 | Ervin, Jr. | 182/3 |
| 4,100,996 | A | * | 7/1978 | Sharp | 182/3 |
| 4,272,850 | A | * | 6/1981 | Rule | 2/24 |
| 4,384,372 | A | * | 5/1983 | Rector | 2/300 |
| 4,401,246 | A | * | 8/1983 | Dickinson et al. | 224/150 |
| 4,795,399 | A | * | 1/1989 | Davis | 2/460 |
| 4,887,318 | A | * | 12/1989 | Weinreb | 2/268 |
| 5,155,869 | A | | 10/1992 | Ralli et al. | |
| 5,174,410 | A | * | 12/1992 | Casebolt | 182/3 |
| 5,259,833 | A | * | 11/1993 | Barnett | 602/19 |
| 5,319,806 | A | | 6/1994 | Hermann et al. | |
| 5,590,826 | A | | 1/1997 | Endo | |
| 5,806,733 | A | * | 9/1998 | Smith | 224/264 |

(Continued)

FOREIGN PATENT DOCUMENTS

EP 0 744 192 A 11/1996

(Continued)

*Primary Examiner* — Khoa Huynh
*Assistant Examiner* — Anna Kinsaul
(74) *Attorney, Agent, or Firm* — Fliesler Meyer LLP

(57) ABSTRACT

A device for protecting a shoulder when an object is carried thereon comprises a top layer as well as a bottom layer. The bottom layer comprises a resilient material. The top layer and bottom layer are attached to one another. The top layer comprises rubber, such as styrene butadiene rubber (SBR). The bottom layer comprises at least one recess which exposes the underside of the rubber top layer. A hook and loop fastener is attached to the rubber top layer in said recess. The hook and loop fastener forms a transversely extending loop into which a shoulder strap can be introduced. This device can be used with a safety harness, which is provided with two shoulder straps and two leg straps, or with a pair of dungarees or another garment.

16 Claims, 4 Drawing Sheets

U.S. PATENT DOCUMENTS

| | | | | |
|---|---|---|---|---|
| 6,101,637 | A * | 8/2000 | Lessard | 2/459 |
| 6,202,214 | B1 | 3/2001 | Light | |
| 6,267,280 | B1 * | 7/2001 | Silagy | 224/264 |
| 6,971,476 | B2 * | 12/2005 | Wolner et al. | 182/3 |
| D649,291 | S * | 11/2011 | Cappuccio | D29/101.2 |
| 2002/0184695 | A1 | 12/2002 | Fowler | |
| 2005/0037189 | A1 * | 2/2005 | Palmer et al. | 428/304.4 |
| 2005/0229286 | A1 * | 10/2005 | Tseng et al. | 2/161.2 |
| 2006/0054387 | A1 * | 3/2006 | Fortin | 182/3 |
| 2006/0210789 | A1 * | 9/2006 | Ko | 428/315.9 |
| 2007/0143908 | A1 * | 6/2007 | Phillips | 2/459 |

FOREIGN PATENT DOCUMENTS

| | | | |
|---|---|---|---|
| JP | 2004 091951 | A | 3/2004 |
| NL | 1 016 273 | C1 | 3/2002 |

* cited by examiner

SHOULDER PROTECTOR AND SAFETY HARNESS

The invention relates to a device for protecting a shoulder when an object is carried thereon, comprising a top layer, which comprises rubber, as well as a bottom layer, which comprises resilient material, which top layer and bottom layer are attached to one another.

In the building industry, heavy objects are regularly carried on the shoulder. A scaffolding builder, for example, carries frame tubes, planks and the like on his shoulder on a virtually daily basis. As a result, his shoulder will locally be subjected to a heavy load, which may result in damage to the nervus thoracicus longus. This is the nerve between the collarbone and the top rib, which extends underneath the neck muscles in the so-called shoulder dimple. This damage to the nerve causes a disorder which is referred to as paralysis of the musculus serratus anterior. In this case, a protruding shoulder blade or "wing" develops on the back below the shoulder which is being overstressed. In the Netherlands, this disorder is recognized as an occupational disease.

NL1016273 discloses a shoulder protector which comprises a bottom layer of resilient material and a top layer made of hard material. The weight of the object to be carried is in this case transferred via the top layer of hard material to the bottom layer of resilient material. Said bottom layer distributes the weight load over as large a surface area of the respective shoulder as possible—said shoulder is then subjected to an areal pressure instead of point pressure. This prevents the shoulder from being overstrained locally.

However, one drawback is that said shoulder protector tends to shift when heavy objects are carried on the shoulder. The shoulder protector is then no longer situated in the correct position, so that disorders of the nerves or other neck and/or shoulder disorders may result.

In addition, the hard top layer of said shoulder protector reduces the feel for the object resting on the shoulder. This is disadvantageous when transporting the object from one location to another, in particular when maneuvering around a corner.

It is an object of the invention to provide an improved device for protecting a shoulder when an object is carried thereon.

This object is achieved according to the invention in that the bottom layer comprises at least one recess or cutout which exposes the underside of the rubber top layer, and in which a hook and loop fastener is attached to the rubber top layer in said recess or cutout, which hook and loop fastener forms a transversely extending loop, into which a shoulder strap can be introduced.

During use, the hook and loop fastener forms a closed loop. A shoulder strap can be introduced into said closed loop, i.e. the shoulder strap runs through the loop. The shoulder protector provided with this hook and loop fastening can be adjusted in a simple manner with respect to the shoulder strap, so that the shoulder protector can be accurately positioned relative to the shoulder. When objects are subsequently carried on the shoulder protector, the shoulder strap, in the longitudinal direction, bears against a resilient part of the bottom layer of the shoulder protector and underneath the loop of the hook and loop fastener against the underside of the rubber top layer. As a result, the shoulder strap is securely attached during use—the shoulder strap and the shoulder protector are secured with respect to one another. Consequently, it is ensured that the shoulder protector remains in the correct position when objects are carried on the shoulder. This is important in order to prevent nerve disorders or other neck and/or shoulder disorders.

In addition, the rubber top layer of the device according to the invention is slightly resilient. According to the invention, both the bottom layer and the top layer are made from a resilient material. As a result, the bottom and top layer together are able to sufficiently distribute the weight load of the object on the shoulder over as large as possible a surface area, while maintaining the feel for the object to a sufficient degree.

The rubber top layer is also weatherproof—the properties of the shoulder protector are not affected by the temperature outside. The rubber top layer also provides a relatively rough carrying surface, so that inadvertent shifting of the heavy object hardly occurs, if at all. The rubber top layer is in addition (highly) wear-resistant, which has a favorable effect on the service life of the shoulder protector.

By using the shoulder protector according to the invention, people with shoulder symptoms can return to work again sooner. In addition, it has been found that by using this shoulder protector people carrying a heavy object on their shoulder walk in a more upright position. This is advantageous from an ergonomic point of view and reduces the risk of back pain. The occurrence of occupational cervical disorder will also be reduced, i.e. a neck disorder which results from bending the neck while carrying a heavy object on the shoulder.

In one embodiment, the hook and loop fastener has two lips, in which the upper side of the first lip can interact with the underside of the second lip through a hook and loop action, and in which each of the lips has a securing edge, which is attached to the underside of the rubber top layer in the longitudinal direction. In use, the securing edges extend essentially parallel to a shoulder strap received in the transversely extending closed loop of the hook and loop fastener. For example, the lips of the hook and loop fastener are sewn to the top layer.

The rubber of the top layer may comprise any kind of synthetic and/or natural rubber. The rubber of the top layer comprises, for example, styrene butadiene rubber (SBR). The top layer may be formed by a strip of SBR. Standard rubber or another kind of rubber is, for example, also suitable.

In one embodiment, the top layer has a thickness of between 3-7 mm, which thickness is preferably between 4-6 mm, for example essentially 5 mm. The top layer may of course also have a different thickness. A thickness of 4-6 mm, in particular 5 mm, has been found advantageous in combination with a resilient bottom layer and rubber top layer. This thickness is on the one hand sufficient to ensure that the point pressure of the object on the shoulder is distributed in such a manner that no nerve disorder or other neck and/or shoulder disorder results. On the other hand, the shoulder protector remains sufficiently thin, so that the person still has a feel for the object resting on the shoulder. In addition, a relatively thick top layer can bend less easily, so that an object in the central section of the top layer could push the front and rear end thereof upwards. Furthermore, using the abovementioned thickness, the weight of the shoulder protector remains relatively low.

It is possible for the top layer to comprise an integrally formed rubber strip which is provided with incisions running transversely. In use, the rubber strip produced in one piece extends across a shoulder in the longitudinal direction thereof. The incisions extending transversely to the longitudinal direction of the strip facilitate bending of the shoulder protector over the shoulder. Depending on the type of rubber and thickness of the top layer and the depth of the incisions, it may even be possible to roll up the shoulder protector. If the thickness of the rubber strip is essentially 5 mm, the depth of the incisions may, for example, be essentially 3 mm. Obviously, it is possible for the incisions to extend to a greater or lesser depth in the rubber strip.

In one embodiment, the resilient material of the bottom layer comprises ethylene propylene diene monomer or terpolymer (EPDM). The bottom layer is, for example, made from an integrally formed strip of EPDM cell rubber. However, the bottom layer may also comprise a polyethylene (PE) foam layer or another resilient material.

In this case, it is possible for the bottom layer to have a thickness of between 3-7 mm, which thickness is preferably between 4-6 mm, for example essentially 5 mm. This thickness of the bottom layer, in combination with the abovementioned thickness of the rubber top layer, results in a shoulder protector which reduces the risk of nerve disorders or other neck and/or shoulder disorders, provides a sufficiently good feel for the object carried and is relatively light and user-friendly.

The shape and dimensions of the shoulder protector are adjusted to the shoulder of an adult person. The shoulder protector may be of a unisized design or may have different sizes. The top layer has a length of, for example, between 20-30 cm, which length preferably is essentially 25 cm. In this case, the top layer may be provided with a front end, a central section and a rear end, in which the central section is wider than the front end and the rear end. The maximum width of the top layer is, for example, between 10-12 cm, which maximum width preferably is essentially 11 cm.

The invention also relates to a safety harness, comprising two shoulder straps and two leg straps, as well as a device for protecting a shoulder when an object is carried thereon as described above, in which each of the shoulder straps is connected to in each case one leg strap, and in which the device is provided on one of the shoulder straps.

It is possible for the shoulder straps and the leg straps of the safety harness to be connected to one another by attaching them to a coupling piece. The coupling piece is for example formed by a back plate piece, where the shoulder straps and leg straps come together. The safety harness may furthermore comprise additional straps, such as a breast strap which is arranged transversely between the shoulder straps.

In one embodiment, a lifeline is attached to one of the straps of the safety harness. Usually, the lifeline is not longer than 2 meters, for example 1.5 meters. The lifeline can be anchored at an anchor point, for example using a hook at the end of the lifeline. This is advantageous, for example, when the safety harness is used in building scaffolding or other building activities where people are at risk from falling. A scaffolding builder can then attach the hook of the lifeline to a frame tube of the scaffold.

In this case, the lifeline may be provided with a fall absorber. In working situations where people are at risk from falling, a safety harness with a lifeline and fall absorber is desirable or even obligatory. The fall absorber is able to absorb the forces of the fall if the person wearing the safety harness falls.

The invention also relates to an assembly comprising a device for protecting a shoulder when an object is carried thereon as described above, as well as a shoulder strap which is provided through the transversely extending loop of the hook and loop fastener.

The invention will now be explained in more detail with reference to an exemplary embodiment illustrated in the drawing, in which.

Figure 1:
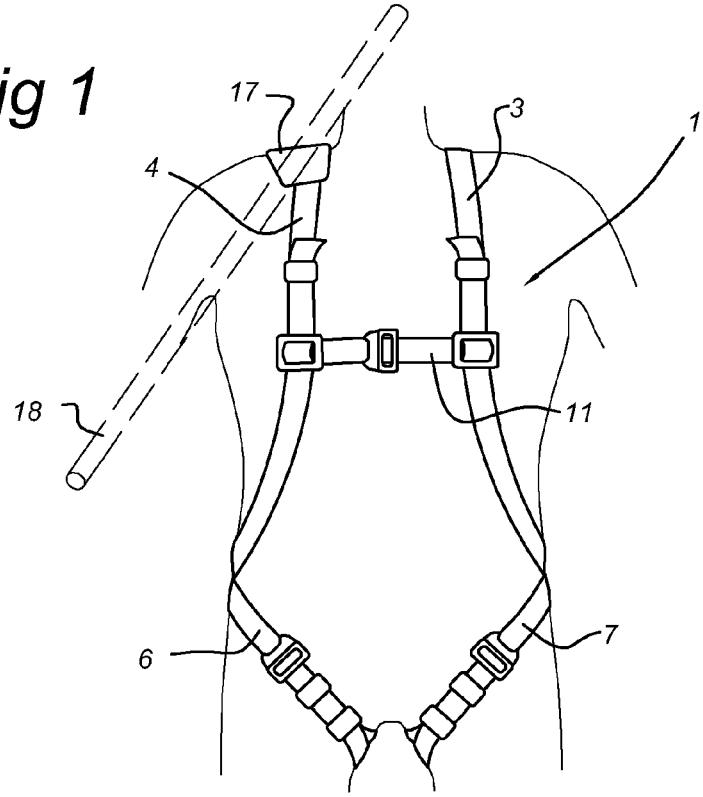
FIG. 1 shows a front view of a safety harness.
Figure 2:
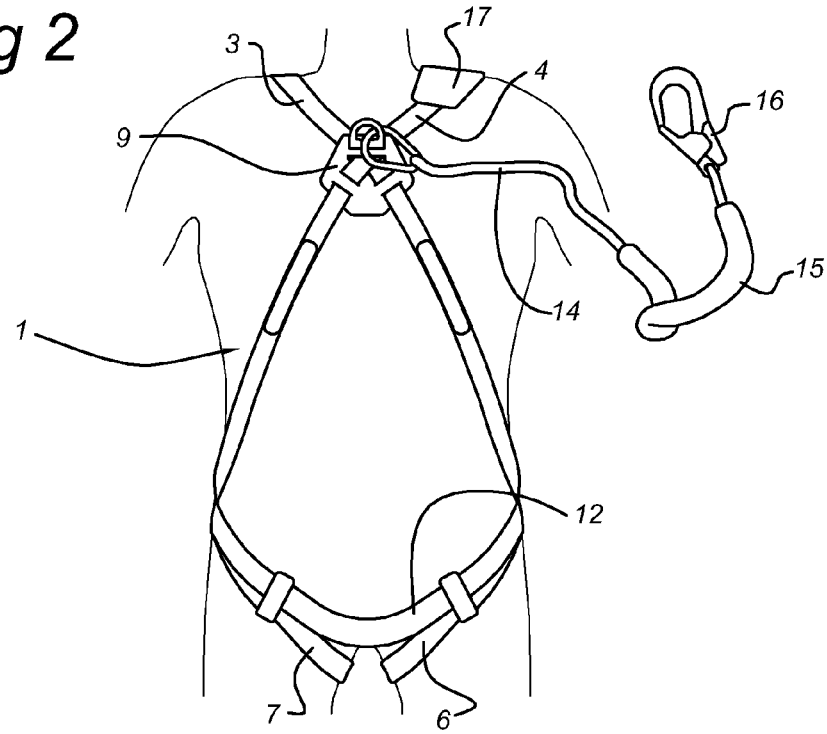
FIG. 2 shows a rear view of the safety harness illustrated in FIG. 1.

FIGS. 1 and 2 show an exemplary embodiment of a safety harness, which is denoted overall by reference numeral 1. This safety harness 1 comprises two shoulder straps 3,4 and two leg straps 6,7. The shoulder straps 3,4 and the leg straps 6,7 are connected to one another. The shoulder straps 3,4 run crosswise across the back through a coupling piece 9. A breast strap 11 is provided between the shoulder straps 3,4. In addition, the safety harness 1 has a hip strap 12.

The safety harness 1 according to this exemplary embodiment forms a fall protection. To this end, the safety harness 1 is provided with a lifeline 14, which can be attached to one of the straps, the coupling piece or another part of the safety harness 1. The lifeline 14 is connected to a hook 16 by means of a fall absorber 15. The hook 16 can be anchored to, for example, a frame tube of a scaffold (not shown).

The safety harness 1 comprises a device 17 for protecting a shoulder when an object 18 is carried thereon. In this exemplary embodiment, the device 17 forms a shoulder protector, which is secured to the safety harness 1. Although the shoulder protector 17 is positioned on the right-hand side in FIGS. 1 and 2, the shoulder protector 17 can be attached to either the left-hand shoulder strap 3 or the right-hand shoulder strap 4.

In addition, the device 17 can be used separately, as an individual shoulder protector. It is also possible to secure the device 17 to a shoulder by other means than a fall strap, for example by means of a single shoulder strap. In addition, the device 17 may for example be attached to a shoulder strap of a pair dungarees or another garment.

Figure 3:
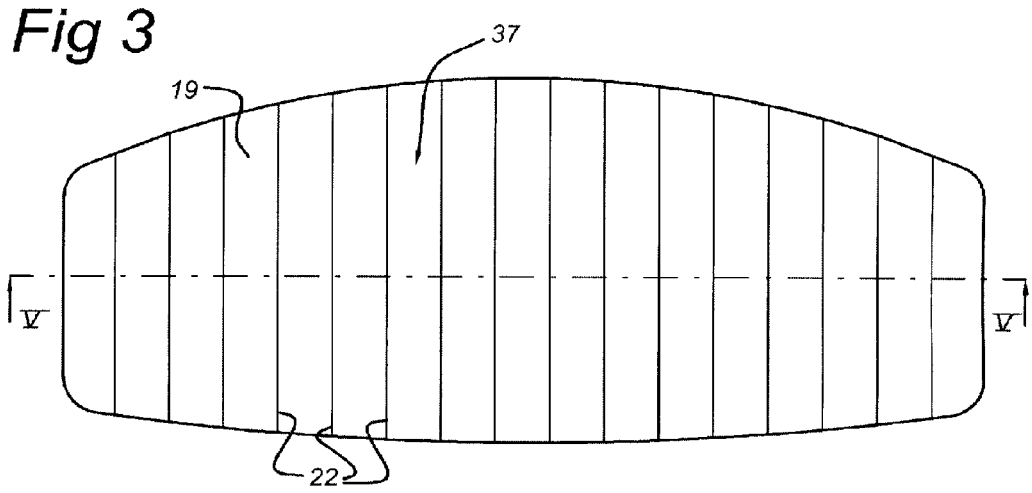
FIG. 3 shows a top view of a device for protecting a shoulder when an object is carried thereon.
Figure 4:
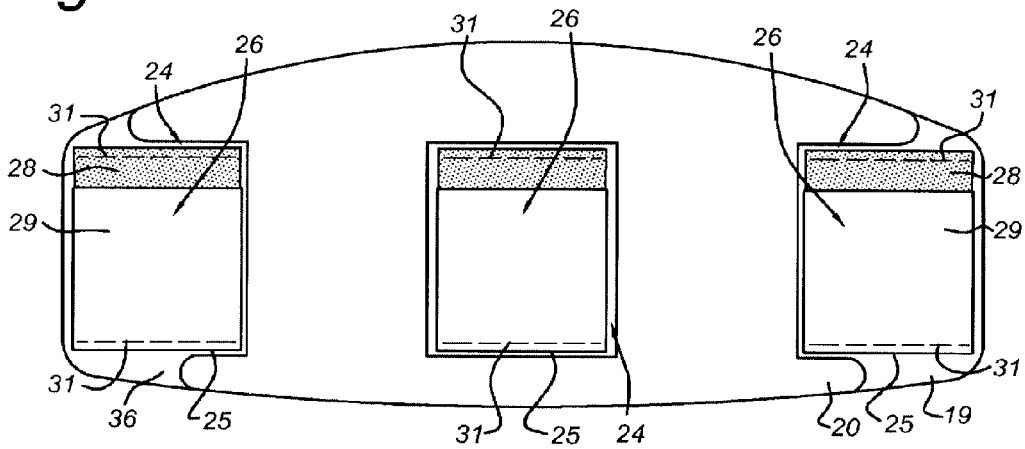
FIG. 4 shows a bottom view of the device illustrated in FIG. 3.
Figure 5:
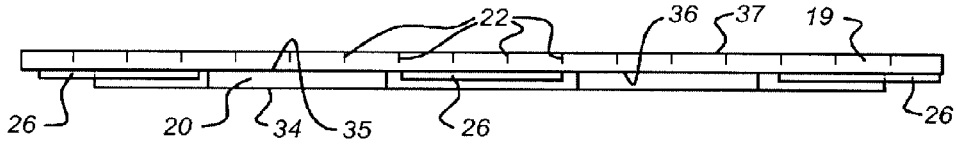
FIG. 5 shows a cross-sectional view along line V-V in FIG. 3.

The shoulder protector 17 is shown in more detail in FIGS. 3-5. The shoulder protector 17 comprises a top layer 19 and a bottom layer 20, which are directly attached to one another. The top layer 19 and the bottom layer 20 each have a bottom surface 36 and 34, respectively, and a top surface 37 and 35, respectively. During use, the bottom surface 34 of the bottom layer 20 faces the shoulder, while the top surface 35 thereof is attached to the bottom surface 36 of the top layer 19. The top layer 19 and the bottom layer 20 are, for example, glued to one another. The top surface 37 of the top layer 19 forms the carrying surface which, during use, is in contact with the object 18 to be carried.

In this exemplary embodiment, the top layer 19 is formed by a strip produced in one piece, which is made from styrene butadiene rubber (SBR). The top layer 19 which is designed as a rubber strip has a thickness of essentially 5 mm. Transversely extending incisions 22 are provided in the top layer 19. In this exemplary embodiment, the incisions 22 are 3 mm deep. The incisions 22 increase the pliability of the shoulder protector 17.

In this exemplary embodiment, the bottom layer 20 is formed by a strip produced in one piece, which is made from a resilient material, such as EPDM or PE foam. In this case, the resilient bottom layer 20 has a thickness of essentially 5 mm. The total thickness of the shoulder protector 17 is approximately 1 cm in this exemplary embodiment.

Figure 8:
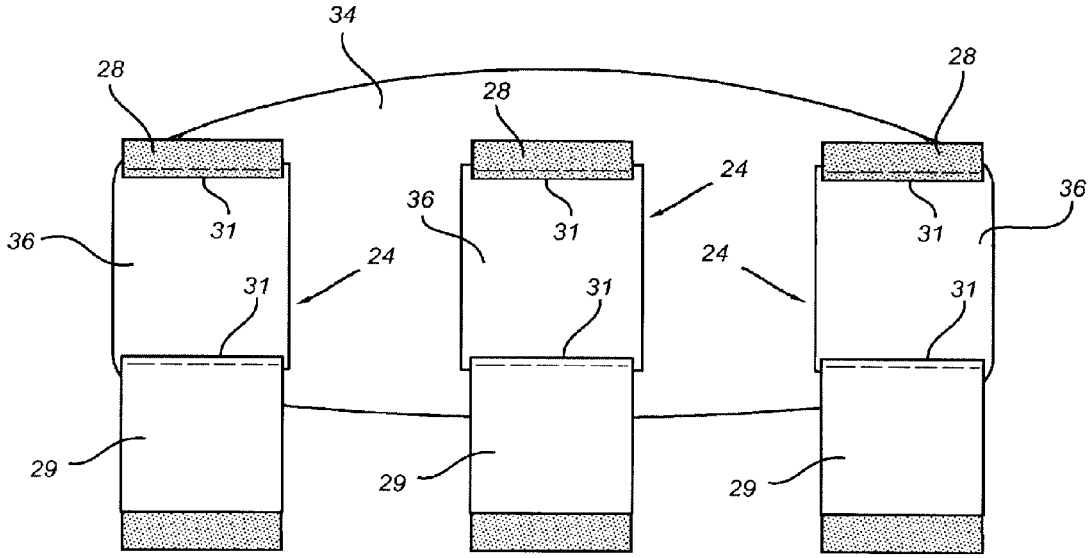
FIG. 8 shows the bottom view of FIG. 4 with the first and second lips of the transversely extending loops separated.

As is illustrated in FIGS. 4 and 8, the bottom layer 20 is provided with three recesses or cutouts 24. Obviously, the number of recesses can be larger or smaller—the bottom layer 20 only has two recesses, for example. The recesses 24 expose the associated parts of the top layer 19. A loop made of a hook and loop fastener (Velcro) 26 is in each case provided in the recesses or cutouts 24.

The hook and loop fastener 26 in each cutout 24 has two lips 28,29. The first lip 28 and second lip 29 each have a securing edge 31, which is sewn onto the bottom surface 36 of the top layer 19. The securing edges 31 extend in the longitudinal direction, in this exemplary embodiment adjacent to the longitudinal edges 25 of the cutouts 24. On the upper side of the first lip 28, a hook structure is provided. The second lip 29 has a loop structure on its underside 11, which can interact with the hook structure through a hook and loop action. Of course, the hook and loop structure can also be arranged the other way around, i.e. underneath the second lip 29 and on the first lip 28, respectively.

Figure 7:
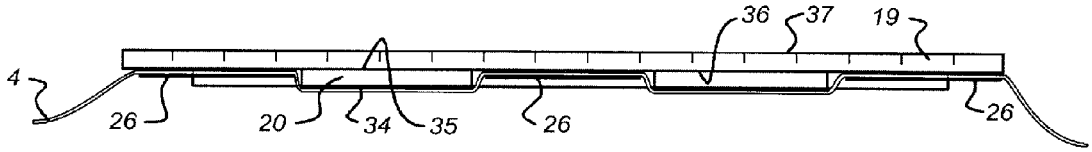
FIG. 7 shows the cross-section view of FIG. 5 with a strap introduced into the transversely extending loops.

As is illustrated in FIG. 7, a shoulder strap, such as the shoulder strap 4 of the safety harness 1, can be fixed between the bottom surface 36 of the top layer 19 and the hook and loop fastener 26 of each cutout 24. This ensures that the shoulder protector 17 is situated in the correct position. In use, the shoulder protector 17 will not, or hardly, shift as a result of the friction between the shoulder strap 4 and the hook and loop fastener 26 and the resilient bottom layer 20.

In this exemplary embodiment, the shoulder protector 17 has a length of approximately 25.5 cm, while the maximum width of the top layer 19 is approximately 11 cm. The top layer 19 achieves its maximum width in the central section of the top layer (see FIG. 3). The front end and the rear end of the shoulder protector 17 are narrower.

Figure 6:
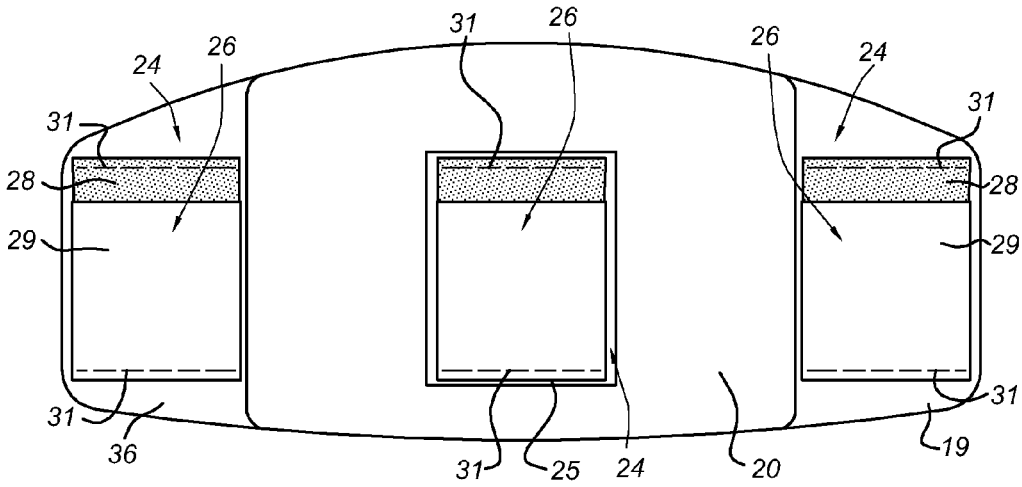
FIG. 6 shows a bottom view of a second embodiment of a device for protecting a shoulder when an object is carried thereon.

FIG. 6 shows a second embodiment of a device for protecting a shoulder when carrying an object thereon. Similar parts are denoted by the same reference numerals. The bottom layer 20 comprises a strip produced in one piece. The strip is made from a resilient material, such as EPDM or PE foam. A central recess or cutout 24 is provided in the strip. The bottom layer 20 has two outer recesses or cutouts 24 on either side of the strip—on the left and right in FIG. 6.

In contrast to the embodiment illustrated in FIGS. 3-5, the outer cutouts 24 are not delimited by projections of the strip, but continue up to the outer edges of the top layer 19. This simplifies production of the strip produced in one piece.

Incidentally, it is also possible for the transverse edges of the central cutout in FIG. 6 to extend up to the outer edges of the top layer (not shown). In that case, the bottom layer 20 for example comprises two separate portions of resilient material, such as EPDM or PE foam, which are arranged at a distance from one another. The central recess or cutout 24 is then situated between these portions and extends over the full width of the shoulder protector.

The invention is not limited to the exemplary embodiment illustrated in the figures. Those skilled in the art can make various modifications which are within the scope of the invention. The shape and dimensions of the top layer and the bottom layer may, for example, be different.

The invention claimed is:

1. A device for protecting a shoulder when an object is carried thereon, comprising a top layer, which comprises rubber, as well as a bottom layer, which comprises resilient material, which top layer and bottom layer are attached to one another, characterized in that the bottom layer comprises at least one recess which exposes an underside of the rubber top layer, and in which a hook and loop fastener forming a transversely extending loop is attached to the underside of the rubber top layer in said recess;

wherein a shoulder strap of a harness or garment can be introduced into the transversely extending loop, so that, when the device is in use and the object is being carried on the top layer, said shoulder strap is secured between the underside of the rubber top layer and bears against the underneath of the transversely extending loop and in an alternating manner against the resilient bottom layer, the shoulder strap adapted to contact a shoulder of the user of the device ensuring that the device is situated in an intended position along the shoulder strap and is generally held in the intended position when the object is carried thereon as a result of the friction between the shoulder strap and the transversely extending loop and the resilient bottom layer.

2. The device as claimed in claim 1, in which the hook and loop fastener has two lips, in which the upper side of the first lip can interact with the underside of the second lip through a hook and loop action, and in which each of the lips has a securing edge, which is attached to the underside of the rubber top layer in the longitudinal direction.

3. The device as claimed in claim 2, in which the securing edges of the lips extend adjacent to the respective edges of the recess extending in the longitudinal direction.

4. The device as claimed in claim 1, in which the rubber of the top layer comprises styrene butadiene rubber (SBR).

5. The device as claimed in claim 1, in which the top layer has a thickness of between 3-7 mm, which thickness is preferably between 4-6 mm, for example essentially 5 mm.

6. The device as claimed in claim 1, in which the top layer comprises an integrally formed rubber strip, which is provided with incisions running transversely.

7. The device as claimed in claim 1, in which the top layer and the bottom layer are glued to one another.

8. The device as claimed in claim 1, in which the resilient material of the bottom layer comprises ethylene propylene diene monomer or terpolymer (EPDM).

9. The device as claimed in claim 1, in which the bottom layer has a thickness of between 3-7 mm, which thickness is preferably between 4-6 mm, for example essentially 5 mm.

10. The device as claimed in claim 1, in which the top layer has a length of between 20-30 cm, which length preferably is essentially 25 cm.

11. The device as claimed in claim 1, in which the top layer is provided with a front end, a central section and a rear end, in which the central section is wider than the front end and the rear end.

12. The device as claimed in claim 11, in which the maximum width of the top layer is between 10-12 cm, which maximum width preferably is essentially 11 cm.

13. A safety harness, comprising two shoulder straps and two leg straps, as well as a device for protecting a shoulder when an object is carried thereon as claimed in claim 1, in which each of the shoulder straps is connected to in each case one leg strap, and in which the device is provided on one of the shoulder straps.

14. The safety harness as claimed in claim 13, in which a lifeline is attached to one of the straps of the safety harness.

15. The safety harness as claimed in claim 14, in which the lifeline is provided with a fall absorber.

16. An assembly comprising a device for protecting a shoulder when an object is carried thereon as claimed in claim 1, as well as a shoulder strap which is provided through the transversely extending loop of the hook and loop fastener.

* * * * *